US008807206B2

(12) United States Patent
Walker

(10) Patent No.: US 8,807,206 B2
(45) Date of Patent: Aug. 19, 2014

(54) PERFORATING GUN DEBRIS RETENTION ASSEMBLY AND METHOD OF USE

(71) Applicant: Halliburton Energy Services, Inc., Houston, TX (US)

(72) Inventor: Jerry L. Walker, Azle, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/001,674

(22) PCT Filed: Nov. 27, 2012

(86) PCT No.: PCT/US2012/066688

§ 371 (c)(1), (2), (4) Date: Aug. 26, 2013

(87) PCT Pub. No.: WO2014/084815

PCT Pub. Date: Jun. 5, 2014

(65) Prior Publication Data

US 2014/0144702 A1 May 29, 2014

(51) Int. Cl.
*E21B 43/116* (2006.01)
*E21B 29/02* (2006.01)

(52) U.S. Cl.
CPC ..... *E21B 43/116* (2013.01)
USPC ..... 166/55; 166/297

(58) Field of Classification Search
CPC ..... E21B 29/00; E21B 29/02
USPC ..... 166/297, 299, 55, 55.6
See application file for complete search history.

(56) References Cited

U.S. PATENT DOCUMENTS

| | | | | |
|---|---|---|---|---|
| 4,529,038 | A | 7/1985 | Brieger | |
| 4,711,299 | A | 12/1987 | Caldwell et al. | |
| 5,613,557 | A * | 3/1997 | Blount et al. | 166/277 |
| 5,952,603 | A | 9/1999 | Parrott | |
| 6,176,313 | B1 * | 1/2001 | Coenen et al. | 166/280.1 |
| 6,464,019 | B1 | 10/2002 | Werner et al. | |
| 7,237,486 | B2 | 7/2007 | Myers, Jr. et al. | |
| 7,430,965 | B2 | 10/2008 | Walker | |
| 7,441,601 | B2 | 10/2008 | George et al. | |
| 7,607,379 | B2 | 10/2009 | Rospek et al. | |
| 2002/0189482 | A1 | 12/2002 | Kneisl et al. | |
| 2005/0115441 | A1 | 6/2005 | Mauldin | |
| 2007/0107589 | A1 * | 5/2007 | Rospek et al. | 89/1.15 |
| 2008/0230225 | A1 | 9/2008 | Meddes et al. | |
| 2009/0050323 | A1 | 2/2009 | Walker | |

OTHER PUBLICATIONS

Foreign Communication from a Related Counterpart Application, International Search Report and Written Opinion dated May 30, 2013, International Application No. PCT/US12/66688, 9pgs, 2012-IP-054618U1PCT.

* cited by examiner

*Primary Examiner* — Brad Harcourt

(57) ABSTRACT

A perforating gun system comprises at least one charge disposed within a gun body, and a first sleeve disposed within the gun body about the at least one charge. The first sleeve comprises a first expansion section, and the first sleeve is configured to undergo non-uniform expansion in response to the detonation of the at least one charge.

20 Claims, 11 Drawing Sheets

PERFORATING GUN DEBRIS RETENTION ASSEMBLY AND METHOD OF USE

CROSS-REFERENCE TO RELATED APPLICATIONS

This application is a National Stage of and claims priority under 35 U.S.C. §371 to International Application No. PCT/US12/66688, filed on Nov. 27, 2012, entitled, "Perforating Gun Debris Retention Assembly and Method of Use" by Jerry L. Walker which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

During drilling and upon completion and production of an oil and/or gas wellbore, a workover and/or completion tubular string can be installed in the wellbore to allow for production of oil and/or gas from the well. Current trends involve the production of oil and/or gas from deeper wellbores with more hostile operating environments. In order to produce the oil and/or gas from the wellbore, the wellbore is typically perforated to provide one or more fluid pathways through a casing lining the wellbore to the subterranean formation containing the oil and/or gas.

During the process of perforating an oil or gas well, a perforating gun assembly may produce a considerable amount of debris. The debris is primarily chunks of steel from perforating gun charge cases and charge holders as well as powdered zinc from zinc charge cases. As part of the perforating operation, debris may escape from the perforating gun and pass into the wellbore. Once the perforating operating is complete, the debris may accumulate within sections of the wellbore, particularly in horizontal zones and/or above packers in vertical zones.

SUMMARY

In an embodiment, a perforating gun system comprises at least one charge disposed within a gun body, and a first sleeve disposed within the gun body about the at least one charge. The first sleeve comprises a first expansion section, and the first sleeve is configured to undergo non-uniform expansion in response to the detonation of the at least one charge.

In an embodiment, a method of preparing a perforating gun system for use in a perforating operation comprises providing at least one charge disposed within a gun body, and disposing a first sleeve comprising a first expansion section within the gun body about the at least one charge. The first sleeve is configured to radially expand in response to the detonation of the at least one charge.

In an embodiment, a method of perforating a wellbore comprises detonating at least one charge in a gun body, forming a hole in the gun body in response to the detonating, increasing the radius of a first sleeve disposed within the gun body in response to the detonating, where the first sleeve comprises an aperture, and at least partially misaligning the aperture with the hole in the gun body.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
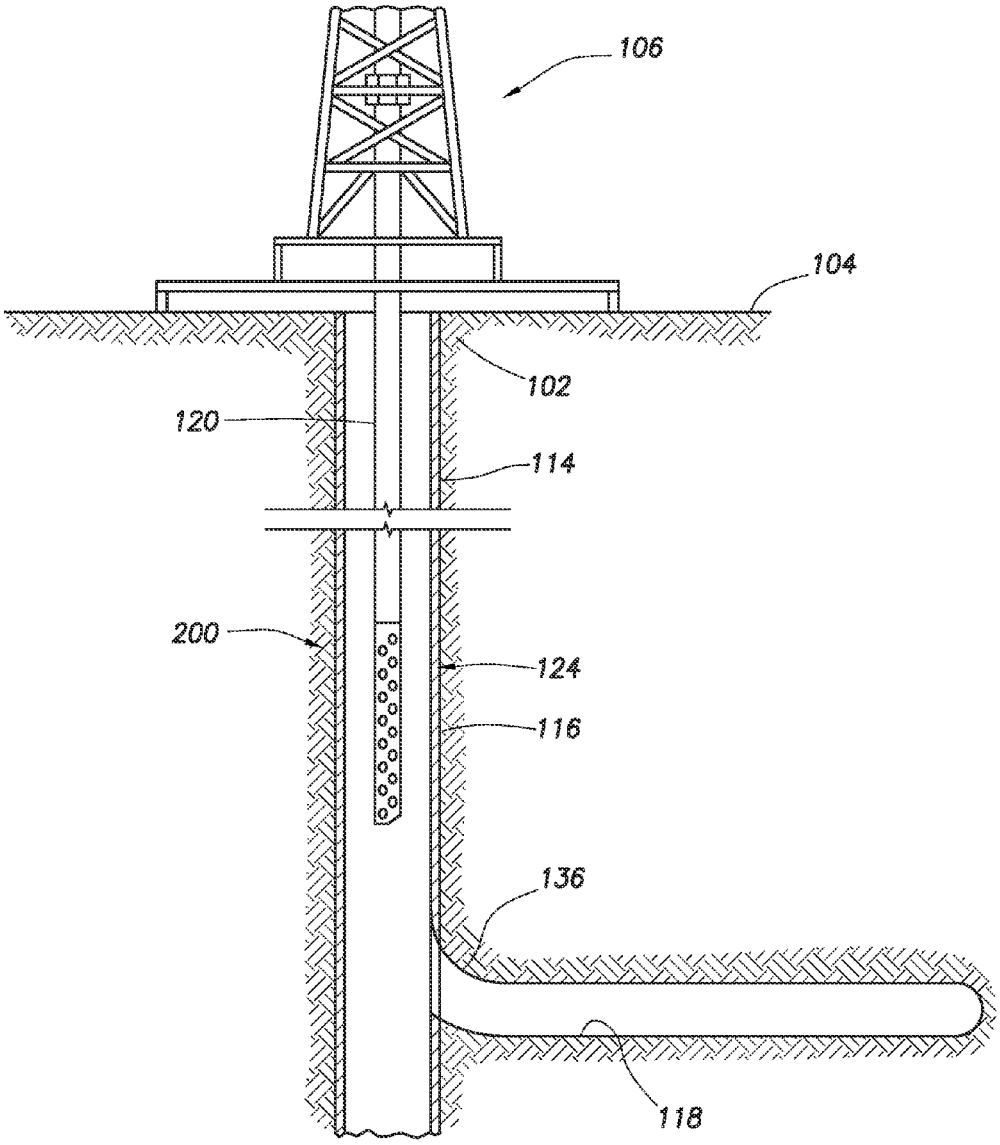
FIG. 1A is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the disclosure may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings. Further, combinations of the embodiments disclosed herein are also contemplated by this disclosure.

Perforating guns used in wellbore servicing operations create perforations through a wall of the wellbore and into the subterranean formation to extract hydrocarbons. When charges in the perforating gun are detonated, a jet channels through the perforating gun body, through the wellbore wall and into the subterranean formation. The pressure resulting from the detonation of the charges may eject debris from the perforating gun and into the wellbore annulus, potentially clogging portions of the wellbore.

As disclosed herein, a perforating gun system may utilize at least one sleeve disposed around the charge(s) within the gun body that is spaced from the inner surface of the gun body before the detonation of the one or more charges in the perforating gun. The sleeve may expand to misalign a hole in the sleeve with a hole created in the gun body by the resulting jet, thereby retaining debris within the perforating gun system after the detonation of the charge. More specifically, pressure created by the detonation of the perforating charge within the perforating gun system may act on the sleeve and expand the sleeve radially outward until it engages the gun body encasing the charges. As the sleeve moves radially outward, the hole through the sleeve, which may be pre-formed and/or created by the jet, may at least partially misalign with the hole through the gun body created by the same jet. The misalignment of the hole in the sleeve with the hole in the gun body may allow the sleeve to at least partially obstruct the hole in the gun body to prevent at least some debris from being ejected out the perforating gun system and into the wellbore. In some embodiments, a second sleeve may be disposed with the first sleeve. The expansion of both sleeves may result in a misalignment of the holes in each sleeve, which may also misalign with the hole in the gun body. The misalignment of the holes in the sleeves may act to retain at least a portion of the debris in the perforating gun. The use of the sleeves within the perforating gun may react to the detonation of the charges, allowing the debris retaining function to be actuated at nearly the same time that the debris is created by the detonation of the charges.

FIG. 1A illustrates a schematic view of an embodiment of a wellbore operating environment in which a perforating gun may be deployed. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both production wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string disposed in the wellbore 114. It should be understood that the wellbore tubular 120 is equally applicable to any type of wellbore tubular being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing, which may be cemented into place in the wellbore 114. In an embodiment, the wellbore tubular string 120 may comprise a completion assembly string comprising one or more wellbore tools, which may take various forms. For example, a zonal isolation device may be used to isolate the various zones within a wellbore 114 and may include, but is not limited to, a plug, a valve (e.g., lubricator valve, tubing retrievable safety valve, fluid loss valves, etc.), and/or a packer (e.g., production packer, gravel pack packer, frac-pac packer, etc.). The downhole tools may comprise the perforating gun system 200.

Figure 1B:
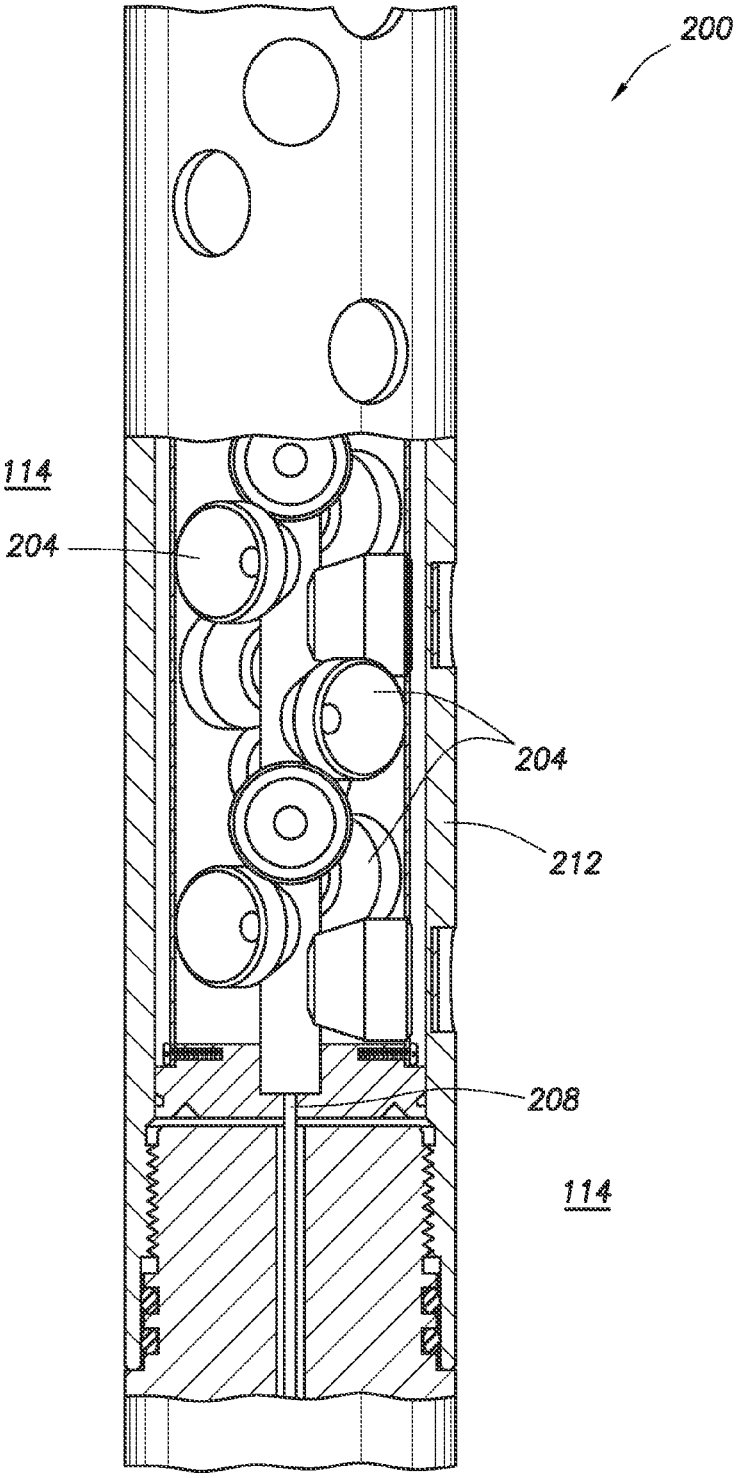
FIG. 1B is a cut-away view of an embodiment of a perforating gun system.
Figure 2A:
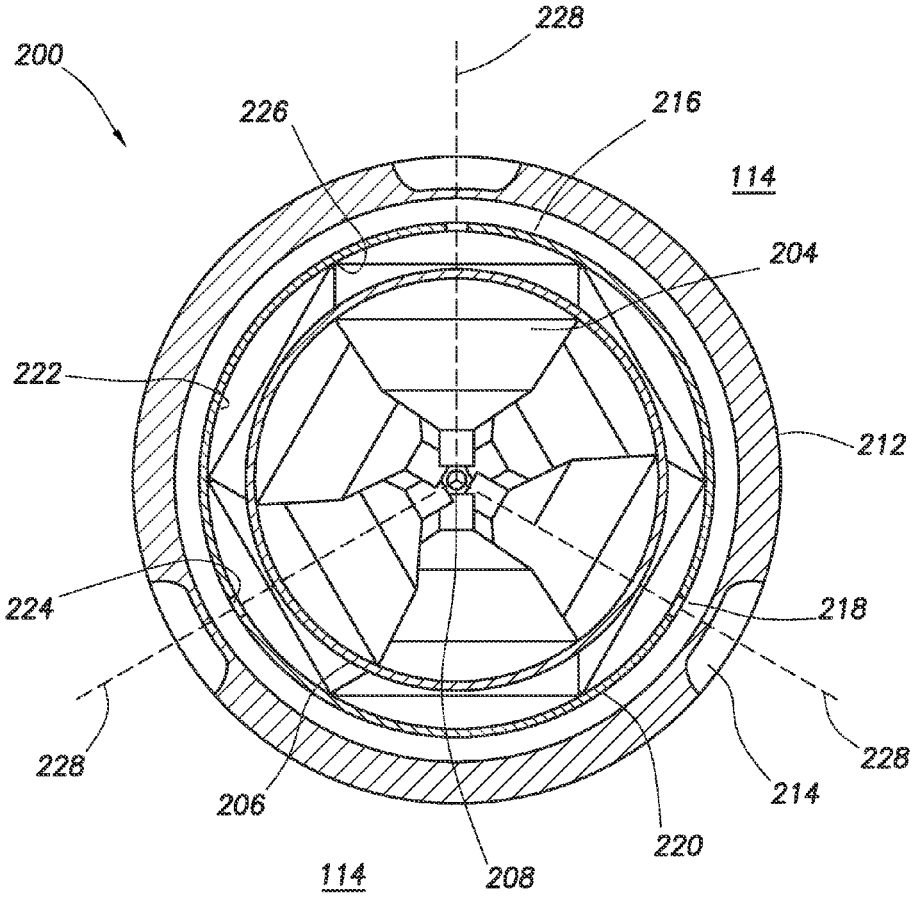
FIG. 2A is a cross-section view of an embodiment of a perforating gun system.

FIG. 1B and FIG. 2A illustrate views of embodiments of the perforating gun system 200. The perforating gun system 200 is configured to reduce and/or limit the accumulation of debris displaced into the wellbore 114 during a perforation operation. The perforating gun system 200 may be configured to retain debris during a perforating operation. The perforating gun system 200 may be of conventional design which may comprise a plurality of perforating charges 204 (e.g., shaped charges) disposed within a gun body 212 that are detonated in order to perforate the casing (e.g., casing 124 of FIG. 1). The perforating gun system 200 may also include elements such as a charge holder 206, a detonation cord 208, boosters, and/or other types of detonation transfer components. The detonation cord 208 may couple to each perforating charge 204. When the perforating gun 202 comprises multiple planes and/or rows of perforating charges 204, the detonation cord 208 may be disposed on the center axis of the perforating gun system 200. In an embodiment, the perforating gun system 200 may include any number of additional components (e.g., end caps, blank sections, spacers, transfer subs, etc.), which may be assembled in a string. The perforating gun system 200 may also comprise a first sleeve 216 and a first expansion section 220. In an embodiment, the first perforating gun system 200 may comprise a first aperture 218 in the first sleeve 216, a second sleeve 222, a second aperture 224 in the second sleeve 222, and a second expanding section 226.

Continuing with FIG. 2A, the perforating gun system 200 may comprise at least one perforating charge 204 disposed within the gun body 212. The perforating charge 204 may be arranged in various configurations, for example, a helical configuration. Any other configuration or pattern of charges 204 as is well known in the art may also be used. The perforating charge 204 may be configured so that the number of charges may be between about 2 shots per foot and about 20 shots per foot. Shots per foot may be shot per longitudinal foot. The perforating charge 204 may be any type of perforating charge that is known in the art. While the perforating gun system 200 is shown in FIG. 2A as one perforating gun system 200, it is to be understood that the perforating gun system 200 may consist of one, two, or more perforating guns systems 200 coupled together with any number (e.g., one, two, or more) of perforating charges 204 per perforating gun system 200 as long as the finally constructed perforating gun system 200 can be fitted into a wellbore. In an embodiment, when a plurality of perforating charges 204 are disposed in the perforating gun system 200, the direction of the explosive focus axes 228 of each perforating charge 204 may be radially offset by a substantially equal amount. Thus, in an embodiment, if three perforating charges 204 are disposed in the perforating gun system 200, the direction of the explosive focus axes 228 may be radially offset by about 120 degrees. The direction of the explosive focus axes 228 may be directed in one or more focused directions and therefore not radially offset by a substantially equal amount. Additionally, while FIG. 2A depicts a plurality of perforating charges 204 disposed in a first plane perpendicular to the axis of the perforating gun system 200, it will be understood that additional planes or rows of additional perforating charges 204 may be positioned above and below the first plane, for example, as shown in FIG. 1B. If one or more perforating charges 204 are disposed on multiple planes, the magnitude of the anticipated force from the jet 332 (see FIG. 3C) and the direction of the explosive focus axes 228 may produce a substantially uniform radial force. In an embodiment, the direction of the explosive focus axes 228 may be directed in one or more focused directions producing, for example, a non-uniform radial force.

In an embodiment, the perforating charge 204 may be a shaped charge that is designed to focus a resulting explosive jet in a predetermined direction, for example an explosive focus axis 228. The focused explosive jet may comprise a cohesive jet and/or a projectile. Each perforating charge 204 may comprise a metal liner surrounded on the concave side by an explosive material, and a casing may surround the explosive material and the liner. The perforating charge 204 may take the general form of a solid of revolution defined by a half-ellipse, a portion of a parabola, a portion of a hyperbola, a half circle, a cone, a frusto-conical shape, or some other shape.

In an embodiment, the perforating gun system 200 may comprise at least one charge holder 206. The charge holder 206 may be configured to retain the perforating charge 204 in planes, oriented in a predetermined direction, and with appropriate angular relationships between the explosive charges and/or rows. Generally, the charge holder 206 may be disposed within the first sleeve 216 and may be disposed over the charge 204 and longitudinally along the perforating gun system 200. In some embodiments, the first sleeve, a second sleeve, and/or an additional sleeve may act as the charge holder 206.

In an embodiment, the perforating charges 204 may be explosively coupled via a detonation cord 208. The detonation cord 208 may be configured to transfer a detonation wave from a detonator along the length of the perforating gun system 200, thereby sequentially detonating each of the perforating charges 204 in rapid succession. The detonation cord 208 may convey the detonation wave between one or more booster charges disposed at opposite ends of a component of the perforating gun system 200. Generally, the detonation cord 208 may comprise a cord-like structure having a generally cylindrical cross section, though other cross-sectional shapes may also be possible. In an embodiment, the detonation cord 208 may generally be thin and flexible to allow the detonation cord 208 to be installed and routed within the various components making up the perforating gun system 200. The detonation cord 208 may comprise a layered structure having an internal explosive core, an optional fiber reinforcement, and an exterior shielding.

Figure 3A:
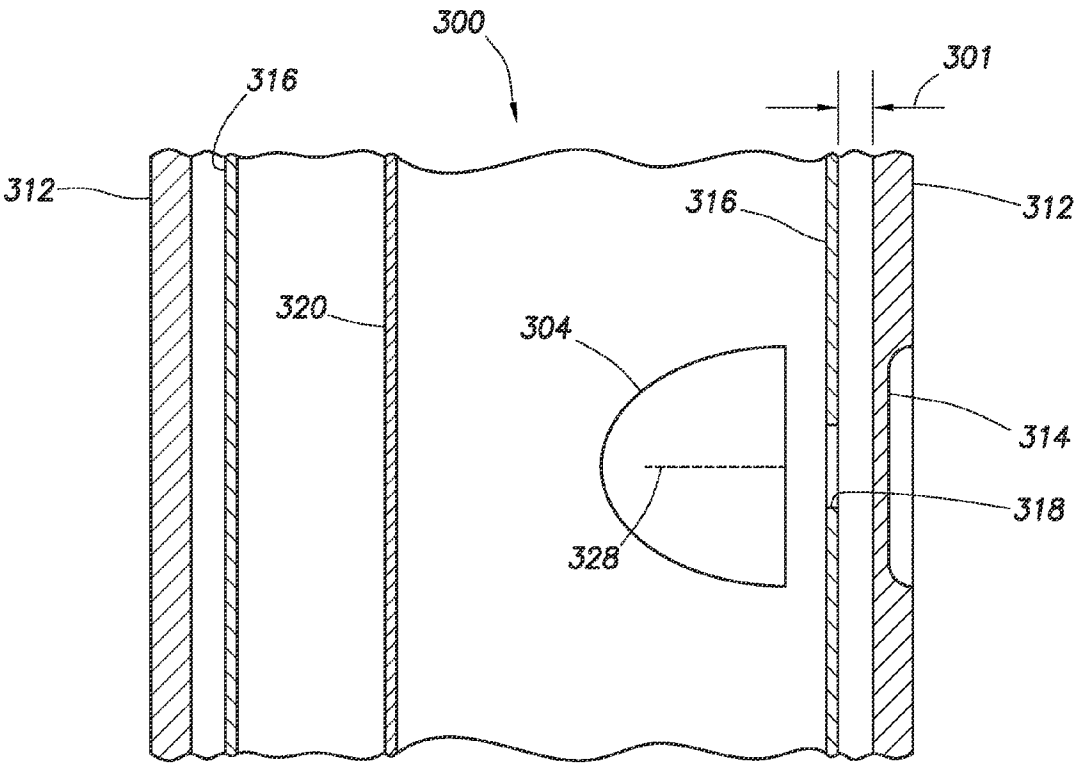
FIG. 3A is a cut-away view of an embodiment of a perforating gun system.
Figure 3B:
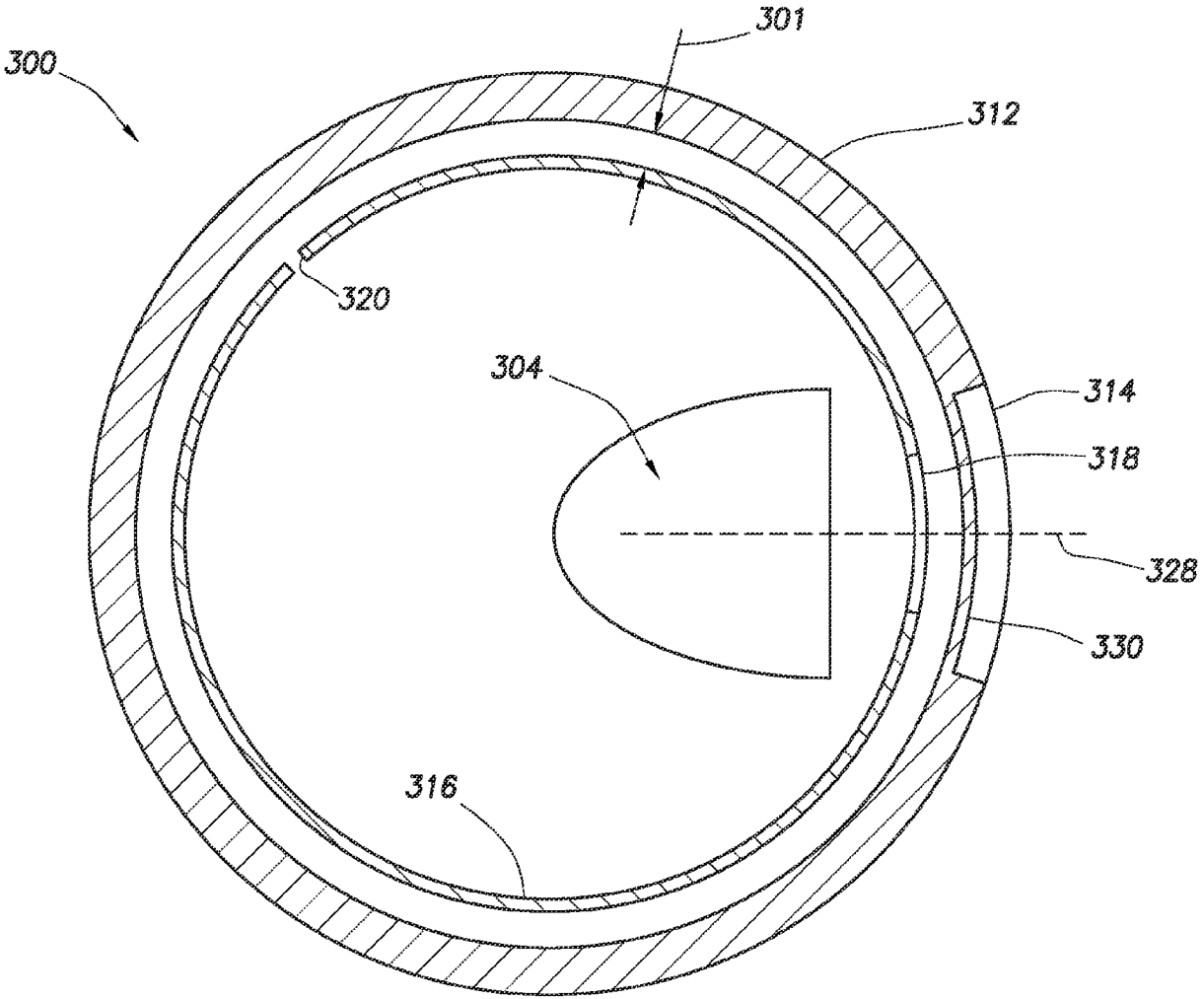
FIGS. 3B-3D are cross-section views of an embodiments of a perforating gun system.

As shown in FIGS. 3A and 3B, an embodiment of the perforating gun system 300 is described. In the embodiment of FIG. 3, the perforating gun system 300 may comprise a gun body 312, which may comprise one or more optional scallops 314 (or in FIGS. 4A and 4B scallop 414). In an embodiment, the gun body 312 is configured to seal the perforating gun system 300 prior to the perforating event. The strength of the gun body 312 may be sufficient to seal the interior of the gun body 312 under high pressure, such as pressure experienced within a wellbore 114. One of ordinary skill in the art would appreciate the range of pressures which may exist within a wellbore during a wellbore operating procedure. In an embodiment, the gun body 312 may be configured to retain at least the first sleeve 316, as previously discussed herein, during a perforating operation and/or after the perforating charge 304 detonates. In an embodiment, the gun body 312 may be constructed of a suitable material such as one or more kinds of steel including stainless steel, chromium steel, and other steels. Alternatively, in an embodiment, the gun body 312 may be constructed of other non-steel metals or metal alloys.

Figure 3C:
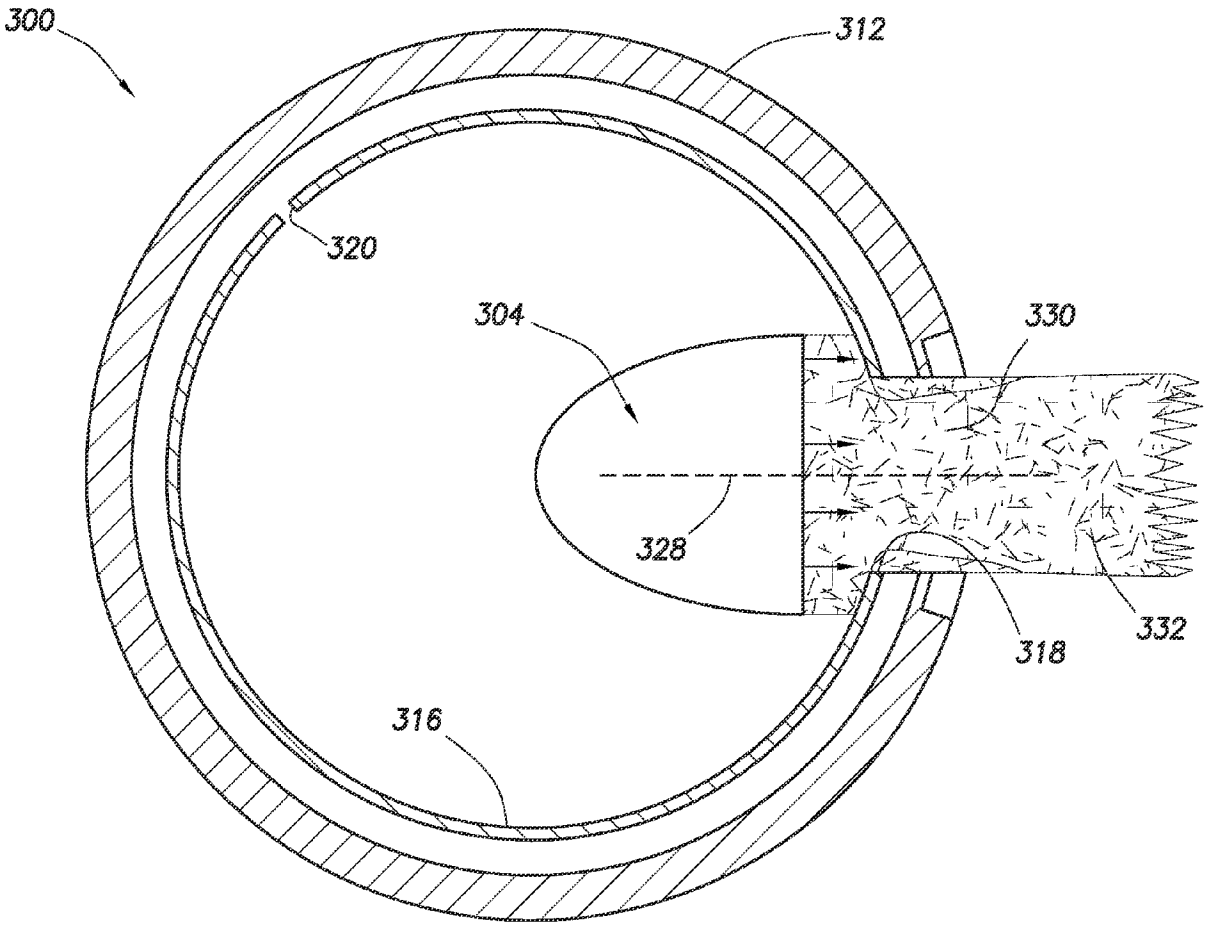

Continuing with FIGS. 3A, 3B, and 3C, in an embodiment, one or more scallops 314 (or in FIGS. 4A and 4B scallop 414) may be disposed in the gun body 312 along the explosive focus axis of one or more of the perforating charges 304. The scallop 314 (or in FIGS. 4A and 4B scallop 414) may reduce the thickness of the gun body 312 at a location aligned with the explosive focus axis 328. In an embodiment, the thickness of the gun body 312 at the location of the scallop 314 as well as the cross-sectional area and cross-sectional shape of the scallop 314 may be configured to minimize the amount of debris ejected into the wellbore 114 during detonation. When the perforating charge 304 is detonated, the resulting jet 332 may perforate the gun body 312. In an embodiment, the reduced thickness of the gun body 312 at the scallop 314 (or in FIGS. 4A and 4B scallop 414) may absorb less of the explosive energy of the jet during detonation, thereby allowing more energy to be used in the formation of a perforation in the adjacent formation. When the jet 332 perforates the gun body 312, a hole or aperture may be formed through the gun body 312 and the jet 332 may continue through the gun body 312 to perforate an adjacent wall of the wellbore 114.

As illustrated in FIGS. 3A and 3B, generally, the first sleeve 316 may be disposed within the gun body 312 about at least one perforating charge 304. While only one perforating charge 304 is illustrated in the interest of clarity, it is to be understood that any number of perforating charges may be used with the perforating gun system 300, as described in more detail herein. In an embodiment, the first sleeve 316 generally comprises a cylindrical tubular member having a first end and a second end. While illustrated as a cylindrical tubular member, the first sleeve 316 may generally comprise any shape configured to approximate that of the inner diameter of the gun body 312 in which it is disposed. The first sleeve 316 may have an inner diameter configured to be placed about the perforating charges 304 within the gun body 312. The outer diameter and/or the thickness of the first sleeve 316 may be configured to allow the first sleeve 316 to be spaced from the gun body 312 by a distance X prior to detonation of the perforating charge 304. The disposition of the first sleeve 316 about the perforating charges may retain the first sleeve 316 in position within the gun body 312 prior to detonation of the perforating charges 304. In some embodiments, a retaining member, or other such device, may be used to retain the first sleeve 316 within the gun body 312. The first sleeve 316 may be constructed of a deformable material (e.g., a material capable of undergoing plastic deformation). In an embodiment, the first sleeve 316 may be constructed of one or more metals, metal alloys, composites or the like such as stainless steel, chromium steel, aluminum, tin, lead, brass, etc.

The first sleeve 316 may extend longitudinally within the gun body 312. The first end and the second end may extend past one or more perforating charges, and in an embodiment, the first end and the second end may extend longitudinally past all of the perforating charges 304 within the perforating gun assembly. The first end and the second end may be open. In some embodiments, the first end and/or the second end may be closed while comprising one or more passageways to allow the detonation cord and/or any other detonation transmission components to pass therethrough. In this embodiment, the first sleeve may translate longitudinally in response to a pressure incident on a closed end.

In an embodiment, the first sleeve 316 may be configured to at least partially obstruct a hole in the gun body 312 in response to the detonation of one or more perforating charges 304. When the perforating charges 304 are detonated and the jet 332 is formed by the perforating charge 304, the jet 332 may pass through the first aperture 318 and/or perforate the first sleeve 316 to form all or a portion of the first aperture 318 before forming a hole in the gun body 312. The first aperture 318 may be pre-formed and/or disposed in the first sleeve 316 before the perforating charge 304 is detonated. The first sleeve 316 may then be aligned with the perforating charges 304 to align the first apertures 318 with the explosive focal axes of one or more of the perforating charges 304. The existence of the first aperture 318 in the first sleeve 316 prior to detonating the perforating charge may result in less debris being released into the wellbore 114. Upon detonation of the perforating charge 304, the pressure within the first sleeve may increase, applying a force to the inner diameter of the first sleeve 316. The resulting force may expand the first sleeve outward through the distance 301. The resulting expansion of the diameter of the first sleeve may result in the first aperture 318 misaligning with the hole in the gun body 312, as described in more detail herein.

In an embodiment, the cross-sectional area and cross-sectional shape of the first aperture 318 may be configured to minimize the amount of debris released into the wellbore 114 during detonation. The cross-sectional area and/or shape of the first aperture 318 may be similar to the cross-sectional area and/or shape of the jet 332. The cross-sectional area of the first aperture 318 may be similar to the cross-sectional area of the face of the perforating charge 304 from where the jet 332 originates. In an embodiment, the cross-sectional shape of the first aperture 318 may be a circle, oval, or polygonal shape. The first aperture 318 may be formed adjacent one or more of the perforating charges 304. In some embodiments, an aperture 318 may be formed adjacent each perforating charge 304, though less than all of the perforating charges 304 may have apertures formed adjacent thereto.

Figure 3D:
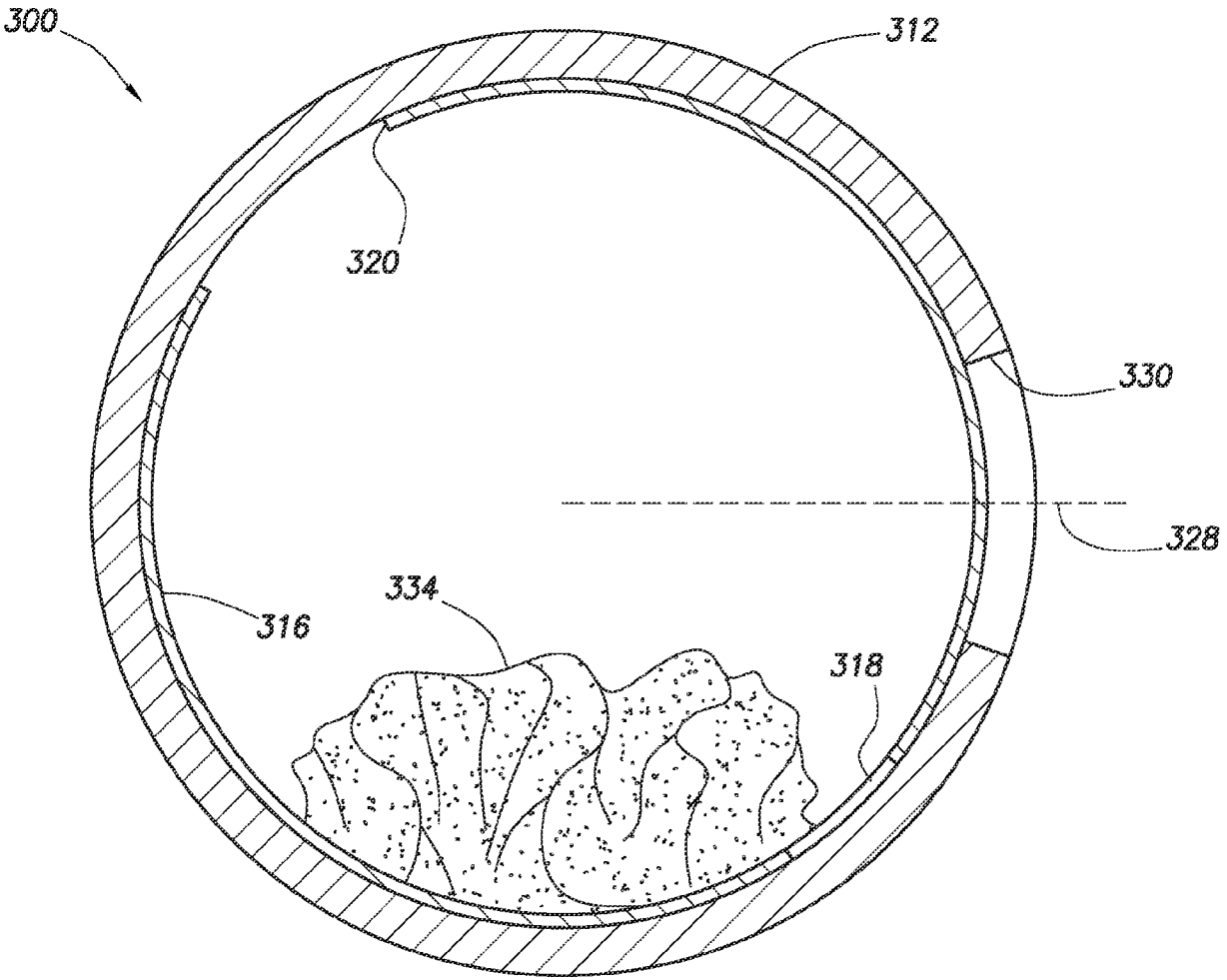

Turning to FIGS. 3C and 3D, an embodiment of the perforating gun system 300 comprising a first expanding section 320 disposed in the first sleeve 316 is illustrated. The first sleeve 316 may be configured to radially expand in response to the detonation of the charge 304, and the first expanding section 320 may be configured to permit the radial expansion of the first sleeve 316 by, for example, increasing in circumferential width in response to the detonation of the at least one charge. For example, when pressure increases within the first sleeve 316, the first expanding section 320 may allow the radius of the first sleeve 316 to increase. With the increase in the circumferential width of the first expanding section 320, the first sleeve 316 may radially expand in a non-uniform manner. As used herein with reference to the expansion of a sleeve, "non-uniform" or "non-uniform expansion" means that at least one point on the sleeve does not expand directly radially outward, but may undergo some amount of circumferential movement or rotation. The non-uniform expansion of the first sleeve 316 may allow for at least some circumferential misalignment of the first aperture 318 with a hole in the gun body due to the least some circumferential movement.

In an embodiment, the first expanding section 320 may comprise a longitudinally disposed split or slit in the first sleeve 316. The slit may be a linear split or a non-linear split. The slit may allow the first sleeve 316 to expand outwards to engage the inner surface of the gun body 312 in response to an increased pressure within the gun body 312 by the perforating event. In this embodiment, the slit may increase in circumferential width as the radius of the first sleeve 316 increases. For example, the first expanding section 320 is illustrated in FIG. 3D as having a greater circumferential width when the first sleeve 316 is radially expanded as compared to the circumferential width of the first expanding section 320 in FIG. 3C when the first sleeve 316 is in the unexpanded (e.g., pre-detonation) configuration within the gun body 312.

Figure 3E:
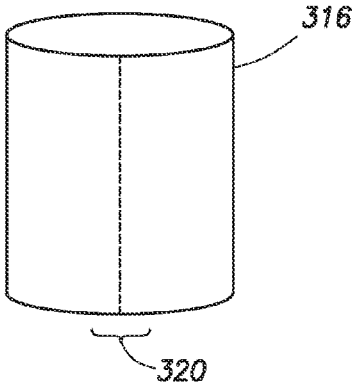
FIG. 3E-3H is a side view of an embodiment of a sleeve.

In an embodiment, additional configurations of the first expanding section 320 are possible. As illustrated in FIG. 3E, the first expanding section 320 may comprise a longitudinally disposed section of the first sleeve 316 that is configured to break when an expansion force is exerted on the first sleeve 316. In this embodiment, first expanding section 320 may comprise a crease, a breakable section, or a series of perforations in the first sleeve 316, and/or a section of reduced thickness on the first sleeve. Upon expansion of the first expanding section 320 of FIG. 3E, the width of the gap between the edges of the first sleeve may increase, resulting in the edge being separated after detonation.

Figure 3F:
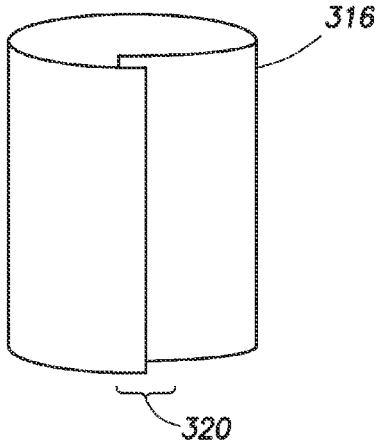
Figure 3G:
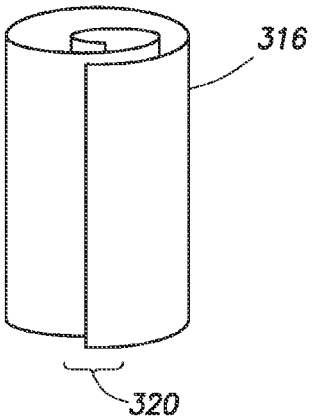
Figure 3H:
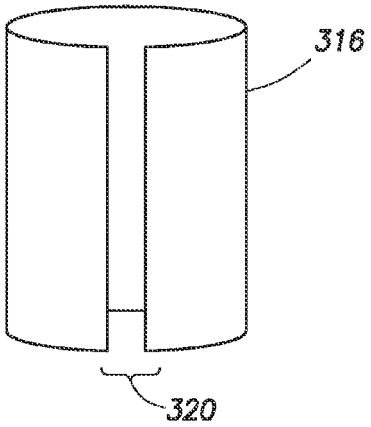

As shown in FIGS. 3F through 3H, the first expanding section 320 may comprise non-engaging ends of the first sleeve 316, where the ends are configured to allow the first sleeve 316 to expand when an expansion force is exerted on the first sleeve 316. In this configuration, the first sleeve 316 may comprise a cylindrically shaped sheet of material where the two ends comprising the first expanding section 320 do not engage to complete the cylinder (e.g., the configuration of FIG. 3H) and/or overlap to some degree (e.g., the configurations of FIG. 3F and FIG. 3G). When the ends of the first sleeve 316 overlap, the ends may overlap to an extend that the expansion of the first sleeve through the distance 301 causes the ends to be non-engaging. In some embodiments, the ends may remain overlapped when the first sleeve expands through the distance 301. This embodiment may prevent any debris from escaping through a hole in the gun body that happens to be aligned with the first expanding section 320.

As shown in FIG. 3G, the ends may overlap to a such a degree that more than one layer of the first sleeve 316 is formed. In this embodiment, the plurality of layers of the first sleeve 316 may each move in opposite directions in response to the expansion of the first sleeve 316, thereby at least partially misaligning any aperture formed through the first sleeve, which may or may not misalign one or more of the apertures in the plurality of layers with a hole in the gun body. For example, as the spiral configuration comprising the plurality of layers of the first sleeve expands, the layers will attempt to unwind, which may move adjacent layers in different directions at different rates. An aperture in each layer that is aligned in the un-expanded configuration may then misalign during expansion.

As noted above, the increased pressure within the gun body 312 may displace the first sleeve 316 towards the gun body 312 when the perforating charge 304 is detonated. As the first sleeve 316 is displaced towards the gun body 312, the radius of the first sleeve 316 may increase, expanding the first expanding section 320. Furthermore, as the radius of the first sleeve 316 increases, the opening through the first sleeve 316 created by the jet 332 may at least partially misalign with the opening through the gun body 312 so that first sleeve 316 at least partially obstructs the hole in the gun body 312. The opening through the first sleeve 316 continues to move out of alignment as the radius of the first sleeve increases. Upon engaging the inner diameter of the gun body 312, the first aperture 318 may be at least partially out of alignment with the hole 330 in the gun body. In an embodiment, the first aperture 318 through the first sleeve 316 may completely misalign with the hole 330 through the gun body 312. The misalignment of the first aperture 318 with the hole 330 may occur in a number of directions including circumferentially, longitudinally, and/or any combination of the two. The resulting misalignment of the first aperture 318 in the first sleeve 316 with the hole 330 in the gun body may at least partially limit or prevent any debris 334 from being released from the perforating gun system 200. Thus, the amount of debris escaping from the perforating gun system 200 and accumulating within the wellbore 114 may be reduced.

Figure 4A:
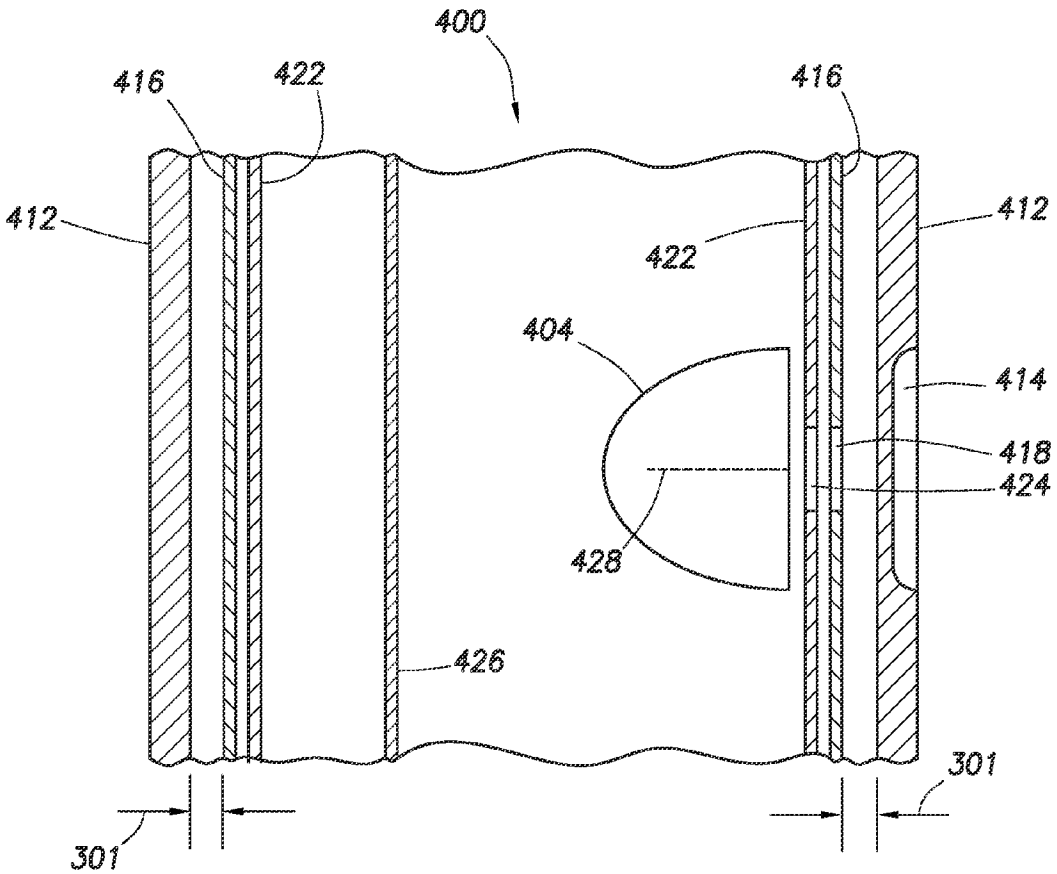
FIG. 4A is a cut-away view of an embodiment of a perforating gun system.
Figure 4B:
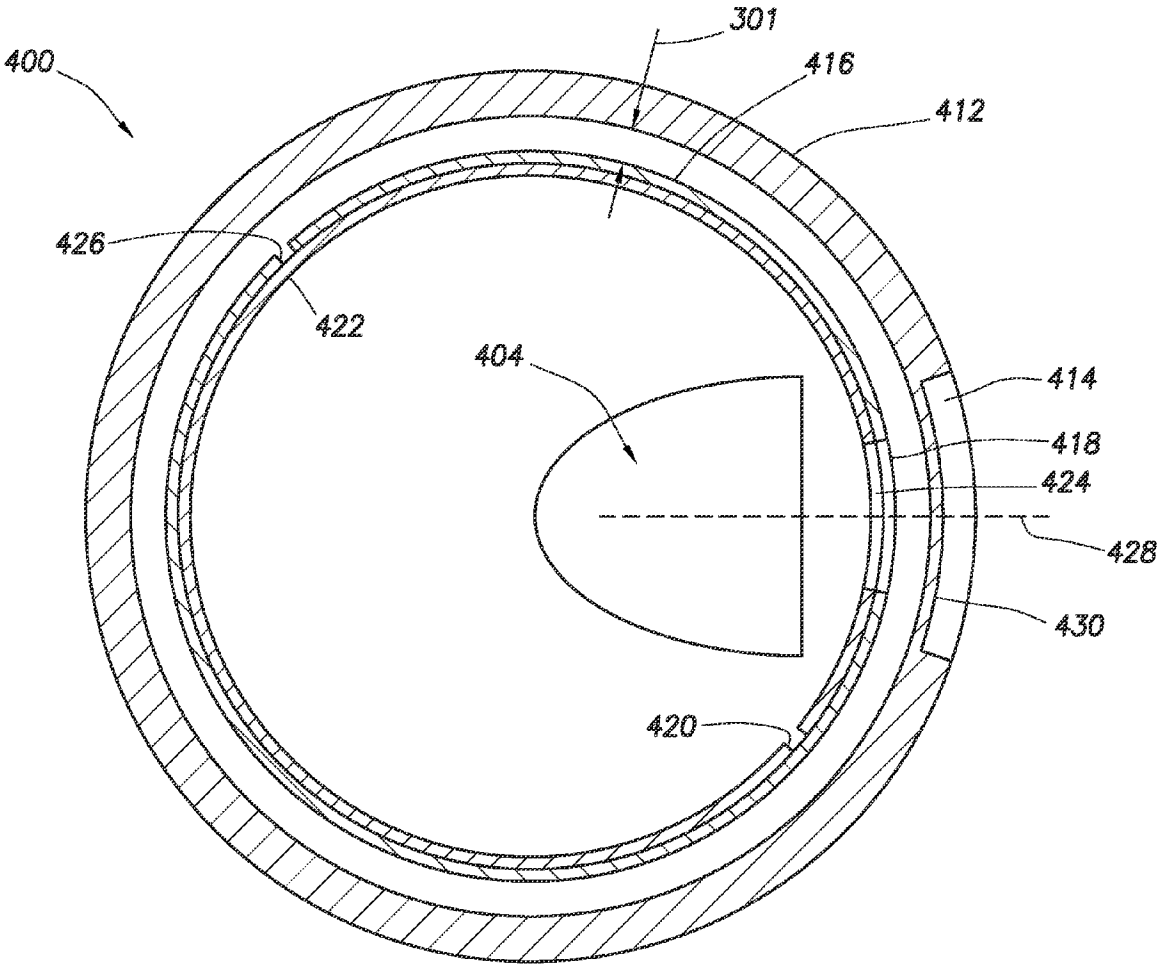
FIG. 4B is a cross-section view of an embodiment of a perforating gun system.
Figure 4C:
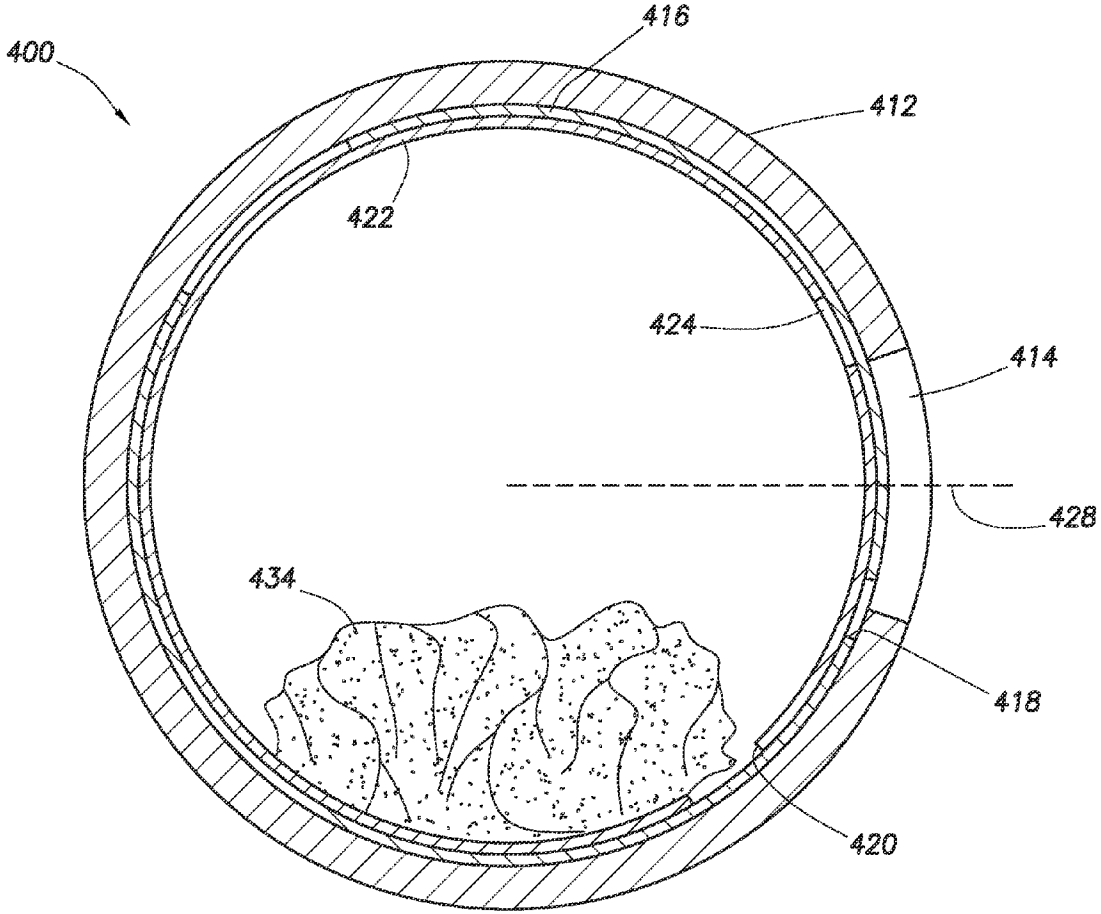
FIG. 4C is a cross-section view of an embodiment of a perforating gun system.

Turning to FIGS. 4A, 4B, and 4C, an embodiment of the perforating gun system 400 depicting a plurality of sleeves is shown. In an embodiment, a second sleeve 422 may be configured to at least partially obstruct a hole 430 in the gun body and/or an aperture 418 in the first sleeve 416 cooperation with the second sleeve 422 in response to detonating the charge 404. In an embodiment, the first sleeve 416 and/or the second sleeve 422 may serve as the charge holder 206. When the perforating charge 404 is detonated and the jet is formed by the perforating charge 404, the jet may perforate may pass through a second aperture 424 in the second sleeve 422 and/or at least partially form the second aperture 424 in the second sleeve 422 before forming the hole 430 in the gun body 412. In an embodiment, a plurality of apertures 418, 424 may be disposed on the plurality of sleeves 416, 422, and the apertures 418, 424 may be configured to provide a passage for the jet to the gun body 412 when the sleeves 416, 422 are in the unexpanded (e.g., pre-detonation) configuration. In this embodiment, less debris may be released into the wellbore 114 due to the plurality of apertures when the perforating charge 404 is detonated.

In an embodiment, the cross-sectional area and cross-sectional shape of the second aperture 424 may be configured to minimize the amount of debris ejected into the wellbore 114 during detonation. In an embodiment, the cross-sectional area and/or shape of the second aperture 424 may be similar to the cross-sectional area and/or shape of the focused explosive energy stream. In an embodiment, the cross-sectional area of the second aperture 424 may be similar to the cross-sectional area of the face of the perforating charge 404 from where the jet originates. In an embodiment, the cross-sectional shape of the second aperture 424 may be a circle, oval, or polygonal shape. As previously discussed, one or more perforating charges 404 may be disposed in one or more planes in the perforating gun system 400. Thus, in an embodiment, for example, if there are three perforating charges 404 disposed in each of three planes, where each of the nine perforating charge 404 faces along nine explosive focus axes 428, one or more second apertures 424 may be aligned with each of the nine explosive focus axes 428-one second aperture 424 for each perforating charge 404. In an embodiment, the second sleeve 422 may be constructed of a generally deformable material. For example, the second sleeve 416 may be constructed of any of the materials described with respect to the first sleeve above. The material used to form the second sleeve 422 may be the same as or different than the material used to form the first sleeve 416.

Continuing with FIGS. 4A, 4B, and 4C, the second sleeve 422 may comprise a second expanding section 426. The second expanding section 426 may be configured to permit a radial increase of the second sleeve 422. The second expanding section may be the same or similar to any of the embodiments described with respect to the first expanding section. In an embodiment, the second sleeve 422 may be a slit longitudinally disposed along the second sleeve 422. The split may be a linear split and/or a non-linear split. The split may increase in size as the radius of the second sleeve 422 increases. The second expanding sleeve 426 may be one or more circumferentially overlapping portions of the second sleeve 422. The second expanding section may have the same configuration as the first expanding section 420 or a different configuration from the first expanding section 420.

In an embodiment, the first expanding section 420 in the first sleeve 416 may be radially offset from the second expanding section 426 in the second sleeve 422. Radially offsetting the expanding sections in a plurality of sleeves may affect the direction of expansion of each sleeve. By radially offsetting the expanding sections, the sleeves may expand in different directions and/or at different rates to thereby allow the apertures in the plurality of sleeves to misalign. In an embodiment, at least two expanding sections in corresponding sleeves may be radially offset by about 5 degrees to about 180 degrees, about 45 degrees to about 180 degrees, or about 90 degrees to about 180 degrees. In an embodiment, the at least two expanding sections may be radially offset by about 90 degrees, and in some embodiments, the at least two expanding sections may be radially offset by about 180 degrees (e.g., as shown in FIG. 4B).

In an embodiment, when the perforating charge 404 is detonated, the resulting pressure increase within the gun body 412 and the plurality of sleeves may displace the plurality of sleeves towards the gun body 412. For example, the first sleeve 416 and the second sleeve 422 may be displaced towards the gun body 412 in response to a pressure increase within the gun body. In this embodiment, as the first sleeve 416 and the second sleeve 422 are displaced towards the gun body 412, the radius of the first sleeve 416 and the second sleeve 422 may increase. In an embodiment, as the radius of the first sleeve 416 and the second sleeve 422 increases, the first expanding section 420 and the second expanding section 426 may allow the first sleeve 416 and the second sleeve 422 to expand. The aperture 418 through the first sleeve 416 and the second aperture 424 through the second sleeve 422 may at least partially misalign with each other so that first sleeve 416 and the second sleeve 422 cooperatively obstruct the fluid pathway out of the interior of the gun body 412, thereby reducing or limiting the amount of debris released into the wellbore 114. Depending on the radial alignment of the expansion sections, the aperture through the first sleeve 416 may rotate out of alignment in a first direction and the aperture through the second sleeve 422 may rotate out of alignment in a second direction, where the first direction and the second direction may not be the same direction. In some embodiments, the aperture through the first sleeve 416 may rotate a first direction and the aperture through the second sleeve 422 may rotate in the first direction, only at a different rotational rate to thereby at least partially misalign the apertures in each sleeve. In an embodiment, only the first sleeve 416 or the second sleeve 422 may move. The aperture 418 through the first sleeve 416 and/or the aperture 424 through the second sleeve 422 may misalign with each other circumferentially, longitudinally, and/or any combination of the two.

In an embodiment, one or more apertures through one or more of the plurality of sleeves may at least partially misalign with the hole in the gun body. For example, the aperture 418 through the first sleeve 416 and/or the aperture 424 through the second sleeve 422 may misalign with the hole 430 through the gun body 412. The opening through the first sleeve 416 and the opening through the second sleeve 422 may also misalign circumferentially, longitudinal, and/or any combination thereof with the hole through the gun body 412. Upon detonation of the explosive charge and generation of pressure within the gun body, the aperture through the first sleeve 416 and the aperture through the second sleeve 422 may expand and move out of alignment with the hole in the gun body 412. The greater the distance 301 of expansion, the greater the radius of the first sleeve and the radius of the second sleeve increases. In turn, the greater increase in the radius of the first sleeve and/or the second sleeve may result in a greater degree of misalignment between the aperture in the first sleeve 416 and the aperture in the second sleeve 422 with the hole in the gun body 412. The resulting misalignment with the hole in the gun body 412 may serve to retain debris within the perforating gun system 400 and/or limit the amount of debris released from the perforating gun system 400. Thus, the amount of debris escaping from the perforating gun system 400 and accumulating within the wellbore 114 may be reduced.

In an embodiment, the plurality of sleeves may comprise at least two sleeves that are closed at one end each, with the closed ends being disposed on opposite sides (e.g., one sleeve having a closed top end and a second sleeve having a closed bottom end). The closed ends may react to the pressure increase within the gun body 412 by moving longitudinally. For example a sleeve having a closed upper end may move up in response to an increased pressure, and a sleeve having a closed lower end may move down in response to an increased pressure. The first and second sleeve may be disposed concentrically within the gun body (e.g., nested) about the one or more perforating charges. The resulting cross section may be as shown in FIGS. 4A to 4C.

In an embodiment with at least two sleeves having closed ends, the pressure increase within the gun body due to the detonation of the charge may cause the first sleeve to move in a first longitudinal direction and the second sleeve to move in a second longitudinal direction, wherein the first longitudinal direction and the second longitudinal direction are opposite each other. The aperture 418 through the first sleeve 416 and the aperture 424 through the second sleeve 422 may at least partially misalign with each other so that first sleeve 416 and the second sleeve 422 cooperatively obstruct the fluid pathway out of the interior of the gun body 412. For example, the apertures may misalign longitudinally to thereby reduce or limit the amount of debris released into the wellbore. In an embodiment, the first sleeve and or second sleeve comprising a closed end may or may not comprise expanding sections, and the first sleeve and the second sleeve comprising a closed end may or may not be used with additional sleeves having open ends and expanding sections. Thus, any combination of the embodiments disclosed herein may be used in the perforating gun assembly, and the resulting misalignment of the various apertures with each other and/or the hole in the gun body 412 may misalign circumferentially, longitudinally, and/or any combination of the two.

In an embodiment, a perforating gun system for use in a wellbore may be constructed by providing at least one charge disposed in a gun body 412. A first sleeve comprising a first expansion section may be disposed in the gun body 412 about the at least one charge and spaced from the interior surface of the gun body 412 by a first distance. The first sleeve may be configured to radially expand in response to the detonation of the at least one charge. In an embodiment, a second sleeve comprising a second expansion section may be disposed within the gun body. The second sleeve may be configured to radially expand in response to the detonation of the at least one charge. The second sleeve may be engaged with the gun body about the at least one charge and/or disposed within or about the first sleeve. The perforating gun system may be disposed in a wellbore. In an embodiment, a first aperture may be provided in the first sleeve, and the first aperture may be radially aligned with the charge. In an embodiment, a second aperture may be provided in the second sleeve, and the second aperture may be radially aligned with the charge.

In use, the perforating gun assembly may be disposed within a wellbore and positioned adjacent a formation to be perforated. When the perforating gun assembly is positioned at a desired location, the at least one charge in a perforating gun system may be triggered to detonate the charge. The pressure within the gun body and/or the one or more sleeves may increase in response to the detonation of the at least one charge. The radius of the one or more sleeves may increase in response to the increased pressure, and the one or more sleeves may expand to engage the inner surface of the gun body. The resulting expansion may result in a misalignment of one or more apertures in one or more of the sleeves with a hole in the gun body. When a plurality of sleeves are disposed within the gun body, the resulting expansion may result in a misalignment of one or more of the aperture in a first sleeve with one or more of the apertures in a second sleeve. A flow path between the interior of the gun body and the exterior of the gun body may be at least partially obstructed due to the at least partial misalignment. At least some debris within the gun body (e.g., fragments of the charges, charge holder, etc.) may be retained within the gun body due to the at least partial misalignment of the apertures with each other and/or with the hole in the gun body.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims.

Each and every claim is incorporated as further disclosure into the specification and the claims are embodiment(s) of the present disclosure.

What is claimed:

1. A perforating gun system comprising:

at least one charge disposed within a gun body; and a first sleeve disposed within the gun body about the at least one charge, wherein the first sleeve comprises a first expansion section, wherein the entire first sleeve is configured to undergo non-uniform radial expansion in response to the detonation of the at least one charge, and wherein the first sleeve is configured to at least partially circumferentially misalign an aperture in the first sleeve with a hole in the gun body after the radial expansion of the first sleeve.

2. The system of claim 1, wherein the first sleeve comprises the aperture, wherein the aperture is aligned with an explosive focal axis of the at least one charge within the gun body.

3. The system of claim 1, the system further comprising at least one charge holder configured to retain the at least one charge within the gun body.

4. The system of claim 1, wherein the first sleeve is configured to at least partially obstruct a passage between an interior of the gun body and an exterior of the gun body in response to the detonation of the at least one charge.

5. The system of claim 1, wherein the first expansion section comprises a slit longitudinally disposed along the first sleeve.

6. The system of claim 1, wherein the first expansion section comprises overlapping ends of the first sleeve.

7. The system of claim 1, wherein the first expansion section comprises a breakable section longitudinally disposed along the first sleeve.

8. The system of claim 1, the system further comprising a second sleeve disposed within the gun body about the at least one charge.

9. The system of claim 8, wherein the second sleeve comprises a second expansion section, and wherein the second sleeve is configured to radially expand in response to the detonation of the at least one charge.

10. The system of claim 1, wherein the second sleeve is disposed concentrically with the first sleeve.

11. The system of claim 1, wherein the second sleeve is configured to at least partially obstruct a passage between an interior of the gun body and an exterior of the gun body in response to detonating the charge.

12. A perforating gun system comprising:

at least one charge disposed within a gun body;

a first sleeve disposed within the gun body about the at least one charge, wherein the first sleeve comprises a first expansion section, and wherein the first sleeve is configured to undergo non-uniform expansion in response to the detonation of the at least one charge;

a second sleeve disposed within the gun body about the at least one charge, wherein the second sleeve comprises a second expansion section, wherein the second sleeve is configured to radially expand in response to the detonation of the at least one charge, and wherein the first expansion section and the second expansion section are radially offset.

13. The system of claim 12, wherein the first expansion section and the second expansion section are radially offset between about 5 degrees and about 180 degrees.

14. A method of preparing a perforating gun system for use in a perforating operation, the method comprising:

providing at least one charge disposed within a gun body; and disposing a first sleeve comprising a first expansion section within the gun body about the at least one charge, wherein the first sleeve comprises an aperture, wherein the aperture is aligned with an explosive focal axis of the at least one charge, wherein the first sleeve is configured to radially expand into contact with an inner surface of the gun body in response to a detonation of the at least one charge and at least partially circumferentially misalign the aperture with a hole in the gun body after the detonation of the at least one charge.

15. The method of claim 14, further comprising disposing a second sleeve comprising a second expansion section within the gun body about the at least one charge, wherein the second sleeve is configured to radially expand in response to the detonation of the at least one charge.

16. The method of claim 14, further comprising providing an aperture in the first sleeve, wherein the aperture is radially aligned with the at least one charge.

17. A method of perforating a wellbore, the method comprising:

detonating at least one charge in a gun body;

forming a hole in the gun body in response to the detonating, wherein a first sleeve disposed within the gun body comprises an aperture, and wherein the hole in the gun body and the aperture in the first sleeve align along an explosive axis of the at least one charge;

increasing the radius of a first sleeve disposed within the gun body in response to the detonating; and at least partially misaligning the aperture in the first sleeve with the hole in the gun body in response to increasing the radius of the first sleeve.

18. The method of claim 17, further comprising;

increasing the radius of a second sleeve disposed within the gun body in response to the detonating, wherein the second sleeve comprises a second aperture; and at least partially misaligning the second aperture with the aperture.

19. The method of claim 17, further comprising retaining debris within the perforating gun system in response to the at least partially misaligning.

20. The method of claim 17, wherein the at least partially misaligning comprises circumferentially misaligning, longitudinally misaligning, or any combination thereof.

* * * * *